United States Patent [19]

Dowd

[11] Patent Number: 4,868,842

[45] Date of Patent: Sep. 19, 1989

[54] CATHODE CUP IMPROVEMENT

[75] Inventor: James J. Dowd, Niles, Ill.

[73] Assignee: Siemens Medical Systems, Inc., Iselin, N.J.

[21] Appl. No.: 27,787

[22] Filed: Mar. 19, 1987

[51] Int. Cl.[4] ..... H01J 35/06

[52] U.S. Cl. ..... 378/138; 378/121; 378/136

[58] Field of Search ..... 378/134, 136, 137, 138, 378/121; 313/346 R, 422

[56] References Cited

U.S. PATENT DOCUMENTS

| | | | |
|---|---|---|---|
| 2,146,900 | 11/1936 | Klinkmann | 378/138 |
| 3,567,928 | 3/1971 | Davies et al. | 378/136 |
| 3,649,861 | 3/1972 | Atlee et al. | 378/134 |
| 3,916,202 | 10/1975 | Heiting et al. . | |
| 3,946,261 | 3/1976 | Holland et al. . | |
| 4,035,685 | 7/1977 | Jacob | 378/136 |
| 4,065,689 | 12/1977 | Pleil . | |
| 4,331,875 | 5/1982 | Wolfe . | |
| 4,573,186 | 2/1986 | Reinhold | 378/136 |
| 4,730,353 | 3/1988 | Ono et al. | 378/136 |

FOREIGN PATENT DOCUMENTS

| | | | |
|---|---|---|---|
| 0210076 | 1/1987 | EPO | |
| 0030292 | 3/1978 | Japan | 378/134 |
| 0108158 | 8/1980 | Japan | 378/138 |
| 0165353 | 9/1984 | Japan | 378/136 |

OTHER PUBLICATIONS

Nema Standard XR, 5-1984, *Measurement of Dimensions and Properties of Focal Spots of Diagnostic X-Ray Tubes.*

*Electron Flow in the Conventional X-Ray Tube,* J. Rodney M. Vaughan-IEEE Transactions on Electronc Devices, vol. Ed. 32, No. 3, Mar. 1985, pp. 654-657.

*Primary Examiner*—Janice A. Howell
*Assistant Examiner*—Joseph A. Hynds
*Attorney, Agent, or Firm*—Lawrence C. Edelman

[57] ABSTRACT

A cathode electrode improvement is disclosed which utilizes a front focus slot having a diverging cross-sectional area to focus an electron beam within an x-ray tube to provide a high emission, small area focal spot.

14 Claims, 4 Drawing Sheets

CATHODE CUP IMPROVEMENT

BACKGROUND OF THE INVENTION

This invention relates to x-ray apparatus, more particularly to an improvement in the cathode electrode for x-ray tubes.

The cathode electrode of an x-ray tube generally comprises one or more helical wire filaments each forming a cylinder, and supported in spaced relationship within an electrically conductive cathode cup. A small voltage impressed across the filament causes filament current to flow and provide a source of electrons; the filament and electrode cup are generally kept at or near the same electrical potential in the x-ray tube.

An anode electrode, which may be stationary or rotating, is positioned within the x-ray tube and a relatively large electrical potential is impressed between the anode and cathode causing electrons generated by the filament to strike the anode in a predetermined area, the image of which is called the focal spot.

The location of the filament in the cup or more particularly, in a focusing slot in the cup, and the shape of the slot determines in part the size and emission, or x-ray generating capability, of the focal spot.

In the past it has been considered desirable for x-ray tubes intended for mammography applications to have a focal spot substantially less than 0.3, in particular, a 0.1 nominal focal spot. The size of x-ray tube focal spots is conventionally identified by reference to a dimensionless number which correlates to the width of the focal spot in millimeters as will be explained more fully below. Prior art tubes which have attempted to achieve such small focal spots have exhibited undesirably low emission levels and unacceptable growth or "blooming" in focal spot size as a function of emission current. For example, a prior art tube has been observed to have emission levels of only 8 to 13 mA of anode-cathode current while exhibiting nearly a two-to-one variation or blooming of a focal spot from 0.185 to 0.36 mm.

To achieve the small focal spot sizes needed for mammography, prior art cathode electrode focusing cups have placed the filament relatively deeply within the back or rear slot of the focusing cup. In addition, relatively close dimensions, for example 0.005 inches spacing between the filament and each side wall of the back slot has been observed in such prior art designs. With such small tolerances, a relatively small movement of the filament could result in shorting of the filament to the side wall, resulting in a tube failure. Furthermore, such a prior art structure severely limits the electron emission of the filament and thereby reduces the anode target loading and ultimately results in poor x-ray emission produced by the tube. The limited emission of this prior art design is believed to be the result of a space-charge-limited mode of filament operation.

SUMMARY OF THE INVENTION

The present invention overcomes disadvantages of the prior art by providing an electron beam having a very small focal spot, for example a nominal 0.1 mm focal spot.

By permitting operation in a temperature-limited mode, as opposed to a space-charge-limited mode, the present invention further provides for greatly increased emission of such a small focal spot even at low anode-cathode potentials such as that used for mammography, e.g., emission above 20 mA at anode-cathode potentials below 50 kV. The present invention provides such a focal spot with substantially reduced blooming, e.g., thirty percent blooming for emission levels between 15 and 40 mA. Specifically, an actual test of one embodiment of the present invention resulted in an actual focal spot width change of 0.2 to 0.26 mm for a 15 to 40 mA emission current change which is within the maximum allowable actual focal spot width of 0.3 mm for a nominal 0.2 (NEMA) focal spot.

Finally the present invention allows for a larger diameter filament helix and relatively larger side spacing between the filament and the side wall of the back slot, for example 0.013 inches, thus improving manufaoturability and reliability of the tube.

DETAILED DESCRIPTION

Figure 1:
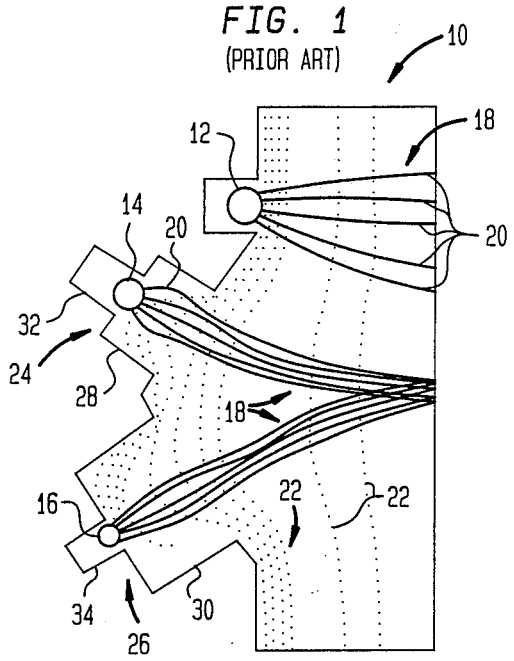
FIG. 1 (PRIOR ART)
FIG. 1 shows a cross-section view of a prior art multifilament cathode cup.

Referring now more particularly to FIG. 1, a simplified cross-sectional view of a prior art multifilament cathode cup 10 may be seen. This cup includes three filaments 12, 14 and 16; each filament emits an electron beam 18 made up of a plurality of rays 20. Filament 12 emits a divergent beam. Filaments 14 and 16 are of different power levels and emit relatively convergent beams with filament 14 providing a relatively large focal spot and filament 16 attempting to provide a relatively small focal spot. Equipotential lines 22 show respective contours of constant electrical field potential. Field forming structures 24, 26 around filaments 14, 16 respectively are formed by parallel sided slots with each structure having an upper or front slot 28, 30 respectively and a lower or rear slot 32, 34 respectively. As may be seen most clearly with respect to cathode structure 26, filament 16 has been observed to be relatively deeply recessed in rear slot 34 to attempt to provide focusing of beam 18 to a small focal spot size. It has been observed that this deep recessing results in greatly limiting the emission of this tube and is believed responsible for the relatively large focal spot blooming observed for this design.

Figure 2:
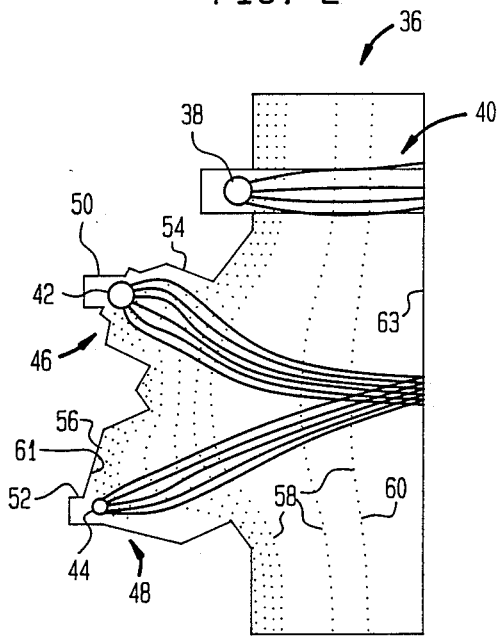
FIG. 2 shows a cross-section view of a multifilament cathode cup electrode constructed in accordance with the present invention.

Referring now more particularly to FIG. 2, a simplified cross-section view of a multifilament cathode cup 36 constructed in accordance with the present invention may be seen. Filament 38 is a relatively high power filament with a generally unfocused beam 40. Filament 42 is an operating filament of relatively lower power with respect to filament 38 and higher power with respect to filament 44 which is the relatively lowest power filament in this structure. Ordinarily filaments 42, 44 are used individually to provide a choice of two operating focal spots. Each of filaments 42, 44 is contained within a focusing structure 46, 48 respectively of cup 36 with each structure having a rear or back slot 50, 52 respectively and a front or focusing slot 54, 56 respectively. Equipotential lines 58 are shown indicating contours of constant electrical potential of the electric field in the cathode cup 36. It is to be understood that the line 60 furthest from the filaments has the highest electrical potential, while line 61 closest to the filaments has the lowest electrical potential, since surface 63 represents a portion of the anode electrode, which is maintained at a relatively high potential with respect to the cathode electrode, resulting in the field represented by lines 58.

Figure 3:
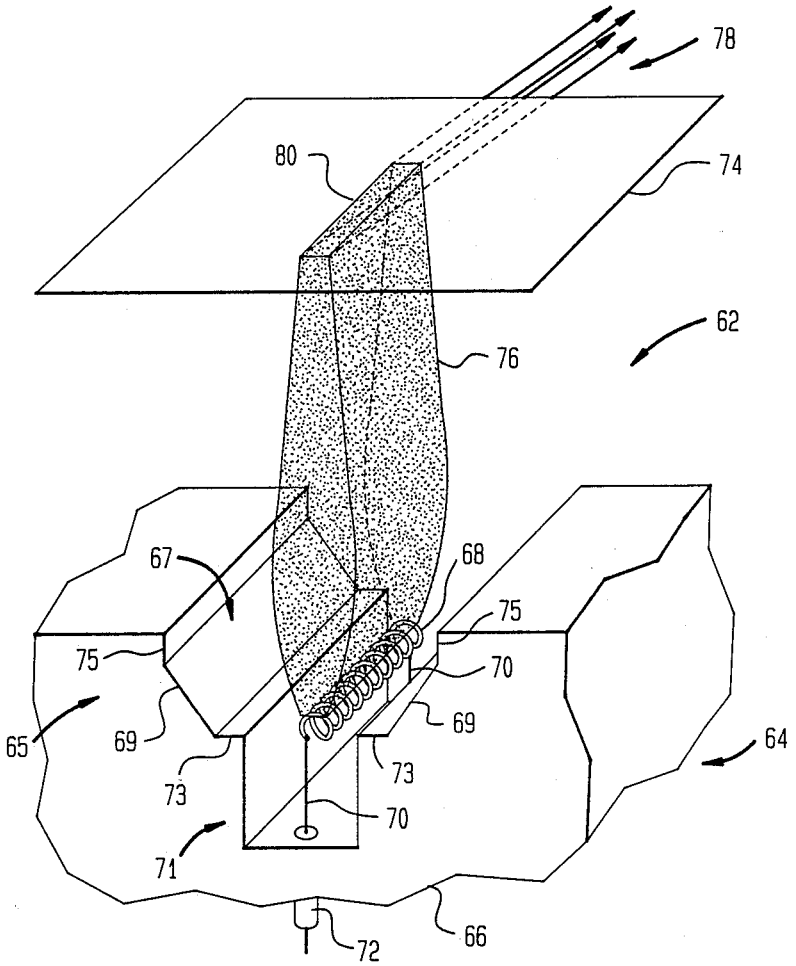
FIG. 3 shows a perspective view of a simplified drawing of cathode and anode electrodes with an intervening electron beam and resulting x-rays.

Referring now more particularly to FIG. 3, a simplified perspective view of the electron beam generating and focusing structure 62 of the present invention may be seen. It is to be further understood that FIG. 3 represents certain x-ray tube features only in simple diagrammatic form to better illustrate features of this invention and that other well known aspects of x-ray tubes, for example, the vacuum environment and motor to rotate the anode, have been omitted. A cathode electrode 64 is provided with: (i) an electrically conductive slotted structure 66 (shown partially cutaway) forming electron beam focusing sidewalls, and (ii) a helical or spiral filament 68. Filament 68 is preferably mounted by its own leads 70, at least one of which is insulated from cathode cup 66 by an insulator 72. Structure 66 is preferably at a potential close to or substantially equal to the cathode potential of the x-ray tube in which it is mounted. Sidewalls 67 further have surfaces 69 diverging in cross-section outwardly from filament 68. As will be shown in greater detail later, surfaces 69 are preferably tangent to a zero-potential electric field line of an electric field which provides a relatively small focal spot with high emission. A nominal 0.1 focal spot with an emission above 15 mA (anode-cathode current) is preferably formed utilizing the cathode cup improvement of the present invention. An anode shown in simple diagrammatic form 74 is maintained at a relatively high electrical potential, for example, up to 50,000 volts or 50 kV with respect to cathode electrode 64. With both an anode-to-cathode voltage and a filament current present, filament 68 generates a beam of electrons 76 which is shaped by slotted structure 66 and received on anode 74, resulting in emission of x-rays 78. The x-rays 78 shown are those passing through a conventional x-ray transparent window in the tube housing (not shown). This results in an apparent square focal spot because of the angle of view with respect to actual rectangular focal spot 80 on anode 74.

It is to be understood that the size of such apparent square focal spots are conventionally identified in the x-ray tube industry by reference to a dimensionless number corresponding to the width (in mm) or shorter dimension of the rectangular focal spot 80. Actual focal spot dimensions may be somewhat larger than the nominal size designation according to industry practice as exemplified by NEMA standard XR 5-1984 entitled "Measurement of Dimensions and Properties of Focal Spots of Diagnostic X-ray Tubes" hereby expressly incorporated by reference. The apparent focal spot may be observed through the use of conventional radiography techniques utilizing a pinhole or slit camera. The length or longer dimension of the rectangular focal spot 80 is generally readily adjustable by adjusting filament length and by providing end tabs or conductive shields (not shown) beyond leads 70 and electrically connected to structure 66. Focusing structure 62 more particularly has a front or focusing slot 65 and a rear slot 71. Front slot 65 has a pair of flat surfaces 73 in the same plane as each other and adjoining the diverging surfaces 69 proximate the filament 68. The plane of surfaces 73 may be parallel to or may contain the axis of the helical filament 68. Surfaces 73 are useful as a reference plane for installing filament 68 and are preferably very small in width to avoid substantially influencing electron beam 76. Focusing slot 65 further has a pair of opposed parallel surfaces 75 adjoining the pair of diverging surfaces 69 distal of the filament 68.

Figure 4:
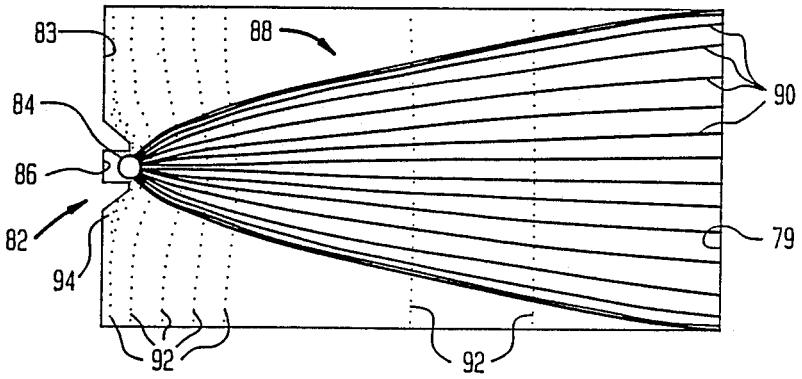
FIG. 4 shows a computer simulation of a cathode-back slot electrode emitting an electron beam towards an anode in free space without external influence.
Figure 5:
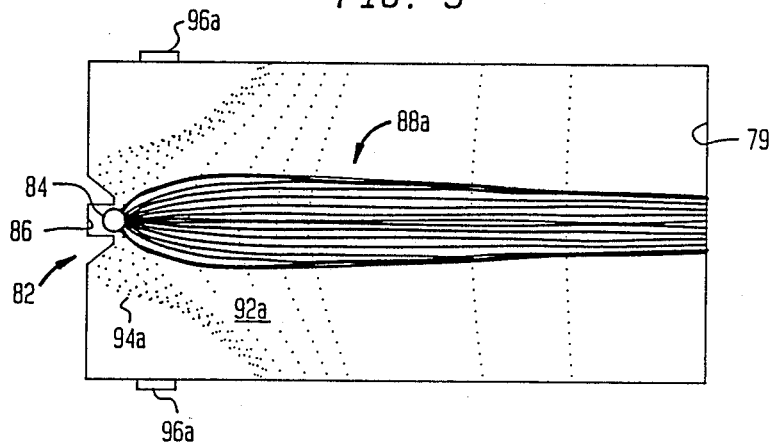
FIG. 5 shows the cathode electrode of FIG. 4 with a single external negative electric potential applied to partially converge the electron beam.
Figure 6:
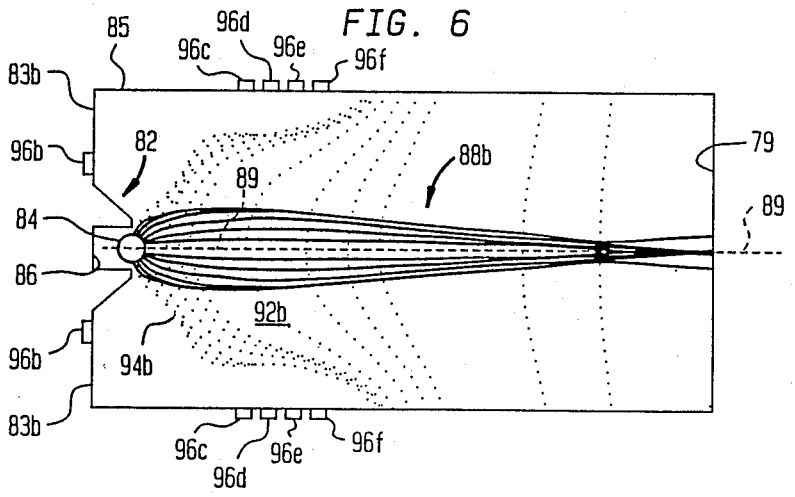
FIG. 6 shows the cathode electrode of FIG. 4 with a group of external negative electric potentials applied to fully converge the electron beam to a desired focal spot size.

FIGS. 4, 5 and 6 depict computer generated plots of electron beams resulting from a cathode electrode with various external electric potentials applied to shape the electric field in the region of the filament and thereby control the electron beam. It is to be understood that electron beam shape is empirically chosen to obtain a desired focal spot size.

In FIGS. 5–8 surface 79 represents the anode, and is held at +50 kV with respect to a cathode electrode 82 which is held at 0 volts potential. The electron beam modeling and shaping shown in FIGS. 4, 6 and 8 may be accomplished by the use of an electron optic modeling program. One such program is "Electron Optics" by Hermann Sfeldt available through Stanford Linear Accelerator, Stanford University, Palo Alto, Calif.

Referring now more particularly to FIG. 4, cathode electrode 82 is formed by a filament 84 and a back or rear slot 86 (shown in cross-section). In FIG. 4 electrode 82 is generating and emitting electron beam 88 in free space, i.e. without any externally applied electric field to focus beam 88. It is to be understood that electrode 82 (including left wall 83) is maintained at zero volts potential, while rich wall or surface 79 is at +50 kV. Beam 88 is made up of a plurality of rays 90.

The associated free space electric field is indicated by lines 92 with the lowest potential electric field line 94*a–c* adjacent electrode 82 and wall 83. In FIGS. 4, 5, 6 and 8 the electric field or equipotential lines 92 and 92*a–c*, shown have been arbitrarily chosen to display more detail of the characteristics of the field generally in the region of the cathode electrode and particularly: i) in the region proximate the filament, and ii) in the region of the electron beam which most significantly affects focusing (i.e. determining focal spot size). Moving from the cathode to the anode, line 94*a–c* represents an equipotential surface in the electric field of 50 volts, while successive lines represent 0.1, 0.25, 0.5, 0.75, 1, 2.5, 5, 7.5, 10, 25 and 35 kV lines or surfaces.

Referring now more particularly to FIG. 5, impressing an external electric potential 96*a* of −7.5 kV at empirically selected symmetrical points with respect to electrode 82 causes electron beam 88*a* to converge and become partially focused because of the reshaped electric field 92*a*. Associated with field 92*a* is a particular lowest potential electric field line 94*a*. It is to be understood that the electric field of interest is the positive portion of field 92*a* between cathode 82 and anode 79. Even though the lowest positive potential electric field line 94a represents +50 volts, it may be considered to be a "zero-potential" electric field line, i.e. the "edge" of the positive potential anode-cathode electric field 92a. The actual 0 volt electric field line is not shown because of the mathematical anomalies encountered in using zero in the computer modeling illustrated in FIGS. 4–8.

Referring now more particularly to FIG. 6, a still further focusing of electron beam 88b may be accomplished by empirically adding additional external electrical potentials, 96b–f, symmetrically with respect to the central axis 89 of beam 88b. In FIG. 6, electric potentials 96b–f are −7.5 kV, −0.5 kV, vening portions of side wall 85 and end wall 83b at 0V. Adding these external negative potentials causes the zero-potential electric field line to assume the shape and position of line 94b, focusing electron beam to 88b to an empirically selected desired focal spot. It is to be understood that selection of the number, placement and voltage of externally applied negative potentials are at the choice of the designer to achieve a desired electric field, electron beam and focal spot. For example, if a relatively large focal spot is desired, field 92a (FIG. 5) may be selected while if a relatively small focal spot is desired, field 92b (FIG. 6) would be selected.

It is to be further understood that it has been found desirable to have filament 84 project or intrude into field 92b and further to have the region of field 92b proximate filament 84 have a high gradient (evidenced by the relative closeness of electric field lines adjacent filament 84) to provide for filament operation in a temperature-limited mode resulting in high focal spot emission.

Figure 7:
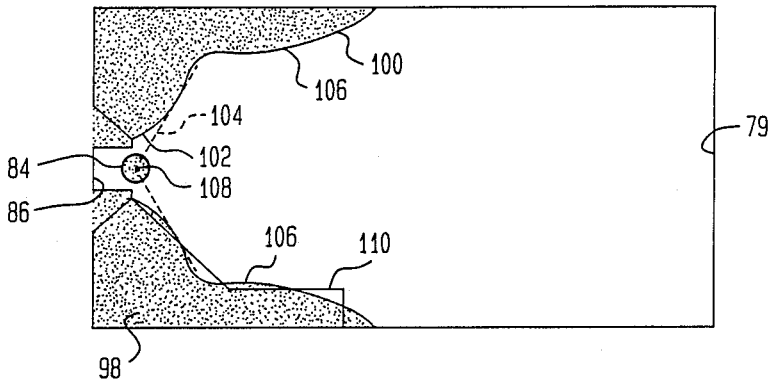
FIG. 7 shows a map of the zero potential electric field region corresponding to FIG. 6.

Once a desired focal spot of minimum or appropriate size is obtained as in FIG. 6, a region 98 having a border 100 of zero electrical potential may be mapped as is shown in FIG. 7. Although region 98 would contain a negative potential in FIG. 6, the electron beam is "indifferent" to the negative potential electric field beyond the zero-potential electric field line 94b, since the positive field 92b is the same whether associated with a zero or negative voltage region. Border 100 of region 98 corresponds to the zero-potential electric field line 94b associated with electric field 92b. Border 100 is to be understood as congruent to the zero-potential electric field line of an electric field which provides a high emission, small dimension focal spot resulting from an electron beam generated by a filament-rear slot cathode electrode operating in free space with empirically determined, externally applied negative electrical cathode potentials. It is believed that the electron beam focusing effect of region 98 is principally caused by diverging portion 102 and secondarily caused by parallel opposed regions 106. Diverging portions 102 are preferably tangent to planes 104 which intersect in a line 108 within the cylinder of helical filament 84.

Figure 8:
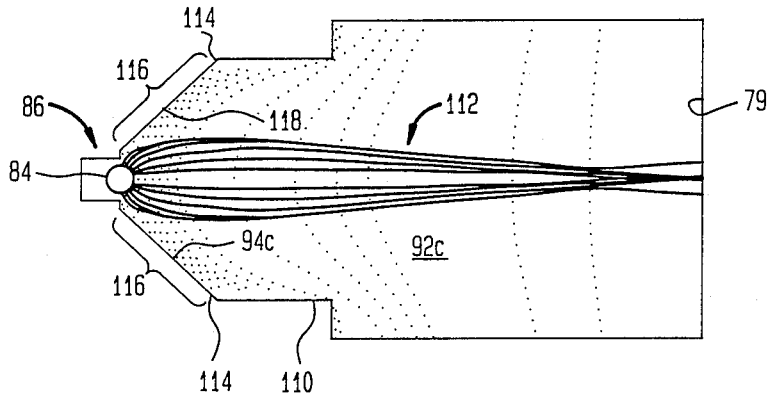
FIG. 8 shows the cross-section of a cathode cup electrode which provides the fully converged electron beam and desired focal spot size of FIG. 6.

As may be seen by reference to both FIGS. 7 and 8, border 100 may be approximated by a contour of segments 110 which are preferably straight lines. Utilizing straight line segments 110 permits a more manufacturable shape for the cathode cup focusing slot while still maintaining the desirable high emission and electron beam focusing effects of border 100. It is to be understood that segments 110 of FIG. 8 are representative of a three dimensional cathode cup as shown in FIG. 3, and result in substantially the same electron beam focusing as that shown in FIG. 6, but without any externally applied electric potentials 96b–f. In other words, the cross-section contour 110 of cathode cup 66 focuses electron beam 112 to substantially the same shape 88b as shown in FIG. 6 by causing electric field 92c to assume a configuration substantially the same as field 92b of FIG. 6. It is to be understood that the slot made up of border 100 or segments 110 is preferably electrically conductive and at zero potential. The vee or trough shaped valley or region formed by diverging walls 114 focuses electron beam 112 to a focal spot less than or equal to 0.2 mm.

Placing the filament 84 intermediate the upper and lower focus slots such that filament 84 is positioned partially within the vee-shaped valley permits a substantially temperature-limited emission central electron beam region with only minor peripheral space-charge limited regions resulting in a substantially constant high emission focal spot area for normal filament currents and anode-cathode voltages useful or permitted for mammography.

The diverging portion 102 in FIG. 7 corresponds in function to diverging surfaces 69 in FIG. 3 even though diverging portion 102 is made up of a pair of opposed convex surfaces and diverging surfaces 69 are planar.

In FIG. 8 the front focusing slot is formed by diverging cross-section 114 generally tangent to a first region 116 of the zero-potential electric field line 94c.

It may thus be seen that this invention permits the use of a larger diameter helical filament extending out of a relatively wide rear slot in contrast to the prior art exemplified in FIG. 1 which required placement of a small filament deep within a relatively narrow and closely spaced rear slot.

It has been found that it is possible to rotate or angle the cathode electrode design of FIG. 8 by as much as 30° to obtain superimposed focal spots without impairing performance. Specifically, rotating or angling the cathode cup slot design 110 results in the focusing cup 48 of FIG. 2. It may be noted that more particularly only the front slot 56 and not rear slot 52 has been rotated in FIG. 2. Although it is possible to rotate rear slot 52, it has been found preferable not to, to permit ease of manufacturing and inspection of various parts of cup 36.

It is to be understood that the same design principles used in the design of focusing cup 48 may be utilized in the design of slots 50, 50 of cup 46.

The invention is not to be taken as limited to all of the details thereof as modifications and variations thereof may be made without departing from the spirit or scope of the invention.

What is claimed is:

1. An improved x-ray tube cathode cup focusing slot having means for applying a side wall potential for providing a focal spot on an anode having high emission, said focusing slot having electron beam focusing sidewalls of electrically conductive material at a potential substantially equal to the cathode potential in the x-ray tube, wherein said focusing sidewalls comprise:

a slot having a generally vee-shaped cross-section comprising first, second and third sections formed adjacent one another in said name order Within successively deeper portions of said cathode cup;

said first slot section beginning at the surface of said cathode cup and said third slot section forming a apex for said focusing slot;

said first and third slot sections having parallel sidewalls, with the sidewalls of said third slot section being spaced apart by an amount so as to at least partially receive a generally helical elongated filament and yet spaced closer together than the sidewalls of said first slot section; and the spacing between the sidewalls of said second slot section becoming gradually smaller in a direction deeper into said cathode cup said sidewalls of said second slot section comprise converging planar surfaces.

2. The focusing slot of claim 1, wherein:

the spacing between upper edges of the sidewalls of said second slot sections equal to the spacing between the sidewalls of said first slot section and the spacing between lower edges of said second slot section is greater than the spacing between the sidewalls of said third slot section so as to form a pair of opposed parallel surfaces at the junction of said second and third slot sections.

3. The focusing slot of claim 2 further comprising a pair of flat surfaces, each:

(i) in the same plane as the other, (ii) proximate said filament, and (iii) adjoining the lower edge of one of said sidewalls of said second slot section.

4. The focusing slot of claim 3 wherein the plane of said flat surfaces is parallel to the longitudinal axis of said helical filament.

5. The focusing slot of claim 3 wherein the plane of said parallel surfaces intersects the cylinder of said helical filament.

6. An x-ray tube for generating x-ray radiation, said x-ray tube including an anode electrode and a cathode electrode having a filament for generating an electron beam to provide a source of electrons for striking said anode electrode, wherein said cathode electrode comprises:

an elongated filament; and a cathode cup having conductive sidewalls forming a valley in said cup having a generally vee-shaped cross-section which begins from a top surface thereof, said vee-shaped valley comprising first, second and third successively narrower slot sections formed adjacent one another in said named order within successively deeper portions of said cathode cup so that an apex of said vee-shaped valley is formed by said third slot section, with said first and third slot sections having parallel sidewalls, the sidewalls of said third slot section being spaced apart by an amount so as to at least partially receive said filament and yet spaced closer together than the sidewalls of said first slot section, and the spacing between the sidewalls of said second slot section becoming gradually smaller in a direction deeper into said cathode cup, said sidewalls of said slot section comprise converging planar surfaces.

7. The x-ray tube of claim 6, wherein:

the spacing between upper edges of the sidewalls of said second slot section is equal to the spacing between the sidewalls of said first slot section and the spacing between lower edges of said second slot section is greater than the spacing between the sidewalls of said third slot section so as to form a pair of opposed parallel surfaces at the junction of said second and third slot sections.

8. The x-ray tube of claim 7, wherein:

said elongated filament is positioned at least partially within said third slot section so that a plane including said pair of opposed parallel surfaces intersects at least a portion of said filament.

9. An x-ray tube having an improved cathode electrode of the type having a plurality of helical filaments, each filament being arranged in a respective generally vee-shaped focus slot formed in a cathode cup for generating a respective one of a plurality of sizes of focal spots, wherein each focus slot comprises first, second and third successively narrower slot sections formed adjacent one another in said named order within successively deeper portions of said cathode cup so that an apex of said vee-shaped slot is formed by said third slot section;

said first and third slot sections having parallel sidewalls, with the sidewalls of said third slot section being spaced apart by an amount so as to at least partially receive said filament and yet spaced closer together than the sidewalls of said first slot section; and the spacing between the sidewalls of said sound slot section become gradually smaller in a direction deeper into said cathode cup, said sidewalls of said second slot section comprise converging planar surfaces.

10. The x-ray tube of claim 9, wherein:

the spacing between upper edges of the sidewalls of said second slot section is equal to the spacing between the sidewalls of said first slot section and the spacing between lower edges of said second slot section is greater than the spacing between the sidewalls of said third slot section so as to form a pair of opposed parallel surfaces at the junction of said second and third slot sections.

11. The x-ray tube of claim 10, further including:

an elongated helical filament positioned at least partially within said third slot section so that a plane including said pair of opposed parallel surfaces intersects at least a portion of said filament.

12. A cathode cup for sue in an x-ray tube including an anode electrode, a cathode electrode having a cathode cup with a focusing slot therein, a filament positioned in said focusing slot and means for applying an electrical potential to electrically conductive focusing sidewalls of said focusing slot so as to provide a focal spot on said anode electrode for electrons emitted from said filament, comprising:

a blank of electrically conductive material and a slot having a generally vee-shaped cross-section consisting of first, second and third successively narrower slot sections formed in said named order within successively deeper portions of said blank so that an apex of said vee-shaped slot is formed by said third slot section, with said first slot section beginning at the surface of said blank, said first and third slot sections having parallel sidewalls with the sidewalls of said third slot section being spaced far enough apart so as to at least partially receive said filament, and the spacing between the sidewalls of said second slot section becoming gradually smaller in a direction deeper into said blank, said sidewalls of said second slot section comprise converging planar surfaces.

13. The cathode cup of claim 12, wherein:

the spacing between upper edges of the sidewalls of said second slot section is equal to the spacing between the sidewalls of said first slot section and the spacing between lower edges of said second slot section is greater than the spacing between the sidewalls of said third slot section.

14. The cathode cup of claim 13, further comprising a pair of flat surfaces, each:

(i) in the same plane as the other, (ii) proximate said filament, and (iii) adjoining the lower edge of one of said sidewalls of said second slot section.

* * * * *